US011142970B2

(12) United States Patent
Gaska et al.

(10) Patent No.: US 11,142,970 B2
(45) Date of Patent: Oct. 12, 2021

(54) BIT CHANGE MECHANISM FOR A DRILL RIG

(71) Applicant: Joy Global Surface Mining Inc, Milwaukee, WI (US)

(72) Inventors: Jason E. Gaska, Columbus, WI (US); Samuel F. Haworth, Oak Creek, WI (US)

(73) Assignee: JOY GLOBAL SURFACE MINING INC, Milwaukee, WI (US)

( * ) Notice: Subject to any disclaimer, the term of this patent is extended or adjusted under 35 U.S.C. 154(b) by 0 days.

(21) Appl. No.: 16/826,540

(22) Filed: Mar. 23, 2020

(65) Prior Publication Data

US 2020/0217153 A1 Jul. 9, 2020

Related U.S. Application Data

(63) Continuation of application No. 15/430,102, filed on Feb. 10, 2017, now Pat. No. 10,597,956.

(60) Provisional application No. 62/294,680, filed on Feb. 12, 2016.

(51) Int. Cl.

| | |
|---|---|
| ***E21B 19/18*** | (2006.01) |
| ***E21B 19/14*** | (2006.01) |
| ***E21B 15/00*** | (2006.01) |
| ***E21B 17/042*** | (2006.01) |

(52) U.S. Cl.

CPC ..... *E21B 19/18* (2013.01); *E21B 15/00* (2013.01); *E21B 17/042* (2013.01); *E21B 19/146* (2013.01)

(58) Field of Classification Search

CPC ..... E21B 19/146; E21B 19/18; E21B 19/20

See application file for complete search history.

(56) References Cited

U.S. PATENT DOCUMENTS

| | | | |
|---|---|---|---|
| 3,265,138 | A | 8/1966 | Alexander et al. |
| 7,438,141 | B2 | 10/2008 | Hinshaw et al. |
| 7,631,704 | B2 | 12/2009 | Hagemeyer et al. |
| 8,342,236 | B2 | 1/2013 | Bienfang et al. |
| 2002/0036101 | A1 | 3/2002 | Huhdanmaki et al. |
| 2003/0111232 | A1 | 6/2003 | Welsh et al. |
| 2006/0162963 | A1 | 7/2006 | Hagemeyer et al. |
| 2014/0083774 | A1 | 3/2014 | Hoult et al. |

(Continued)

FOREIGN PATENT DOCUMENTS

| | | |
|---|---|---|
| CN | 2333822 Y | 8/1999 |
| EP | 0860581 A1 | 8/1998 |

(Continued)

OTHER PUBLICATIONS

Chilean Patent Office Action for Application No. 2017-00364 dated Apr. 15, 2019 (11 pages).

(Continued)

*Primary Examiner* — Giovanna Wright

(74) *Attorney, Agent, or Firm* — Michael Best & Friedrich LLP

(57) ABSTRACT

A bit changer assembly includes a bit basket actuator assembly configured to be coupled to a drill rig. The bit basket actuator assembly includes an actuator, a guiderail, and a bit basket that is movably coupled to the guiderail via actuation of the actuator. The bit changer assembly also includes a bit carousel configured to be coupled to the drill rig, such that the bit carousel is rotatably and vertically moveable relative to the drill rig.

26 Claims, 14 Drawing Sheets

(56) References Cited

U.S. PATENT DOCUMENTS

| | | | | |
|---|---|---|---|---|
| 2015/0315859 | A1* | 11/2015 | Strydom | E21B 19/06 166/379 |
| 2017/0234085 | A1 | 8/2017 | Gaska | |
| 2017/0234086 | A1 | 8/2017 | Gaska | |
| 2018/0291696 | A1 | 10/2018 | Amerson et al. | |

FOREIGN PATENT DOCUMENTS

| | | | |
|---|---|---|---|
| GB | 1034012 | A | 6/1966 |
| SU | 1028831 | A1 | 7/1983 |
| WO | 2008054302 | A1 | 5/2008 |
| WO | 2009156574 | A1 | 12/2009 |
| WO | 2009156575 | A1 | 12/2009 |

OTHER PUBLICATIONS

Chinese Patent Office Action and Search Report for related Application No. 20170077315.X dated Aug. 28, 2019 (7 pages including statement of relevance).

Office Action issued by the Federal Institute of Industrial Property for Application No. 2017104406/03 dated May 14, 2020 (11 pages including English translation).

Office Action issued by the Mexican Patent Office for Application No. MX/A/2017/001892 dated Aug. 25, 2020 (10 pages including English translation).

Office Action issued by the Indian Patent Office for Application No. 201714004847 dated Nov. 4, 2020 (7 pages including English translation).

* cited by examiner

BIT CHANGE MECHANISM FOR A DRILL RIG

CROSS-REFERENCE TO RELATED APPLICATIONS

This application is a continuation of U.S. application Ser. No. 15/430,102, filed Feb. 10, 2017, and claims priority to U.S. Provisional Application No. 62/294,680, filed Feb. 12, 2016, the entire contents of each of which are incorporated herein by reference.

BACKGROUND OF THE INVENTION

The present application relates to drill rigs, and in particular to a bit changing mechanism for use with a blasthole drill rig.

Blasthole drill rigs are commonly used in the mining industry to drill through hard rock. Blasthole drill rigs can be found, for example, in coal, copper, and diamond mines throughout the world. A blasthole drill rig typically includes a base, a drill tower extending vertically from the base, and a drill pipe or pipes that are coupled to and supported by the drill tower, and extend into a borehole. The blasthole drill rig further includes a drill bit coupled to the drill pipe for engaging the mined material. Occasionally, an operator is required to remove the drill bit from the drill pipe and replace the drill bit with another drill bit. However, the drill bit and other components of the drill rig are heavy, and therefore dangerous for an operator to handle. As such, there is a desire to autonomously handle and replace the drill bits and other heavy drill rig components.

SUMMARY

In accordance with one construction, a bit changer assembly includes a bit basket actuator assembly configured to be coupled to a drill rig. The bit basket actuator assembly includes a bit basket and an actuator that moves the bit basket. The bit changer assembly also includes a bit carousel configured to be coupled to the drill rig, such that the bit carousel is rotatably and vertically moveable relative to the drill rig.

In accordance with another construction, a bit changer assembly includes a bit basket actuator assembly configured to be coupled to a drill rig, the bit basket actuator assembly including an actuator, a guiderail, and a bit basket that is moved along the guiderail via the actuator, wherein the bit basket includes a top plate and an aperture disposed in the top plate, and wherein the aperture is sized and shaped for lobes of a drill bit to pass through the top plate and for the drill bit to be positioned in a predetermined orientation in the bit basket. The bit changer assembly also includes a bit carousel configured to be coupled to the drill rig, such that the bit carousel is rotatably and vertically moveable relative to the drill rig, wherein the bit carousel includes a frame having a main plate, and tubes extending from a bottom side of the main plate.

In accordance with another construction, a bit changer assembly includes a bit carousel configured to be coupled to the drill rig, such that the bit carousel is rotatably and vertically moveable relative to the drill rig.

Other features and aspects will become apparent by consideration of the detailed description and accompanying drawings.

Before any constructions of the invention are explained in detail, it is to be understood that the invention is not limited in its application to the details of construction and the arrangement of components set forth in the following description or illustrated in the following drawings. The invention is capable of other constructions and of being practiced or of being carried out in various ways. Also, it is to be understood that the phraseology and terminology used herein is for the purpose of description and should not be regarded as limited.

DETAILED DESCRIPTION

Figure 1:
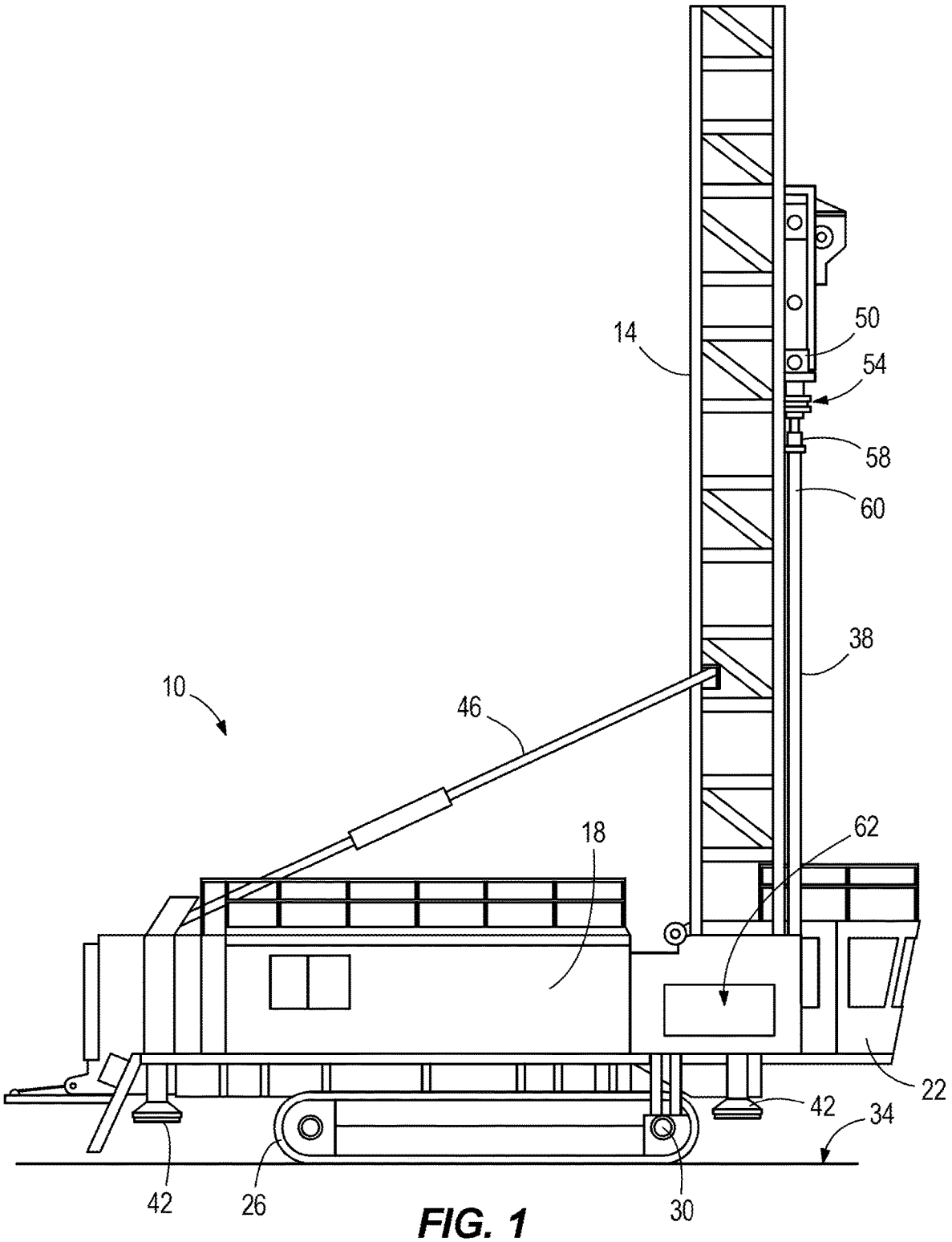
FIG. 1 is a side view of a drill rig according to one construction, the drill rig including a bit changer assembly.
Figure 2:
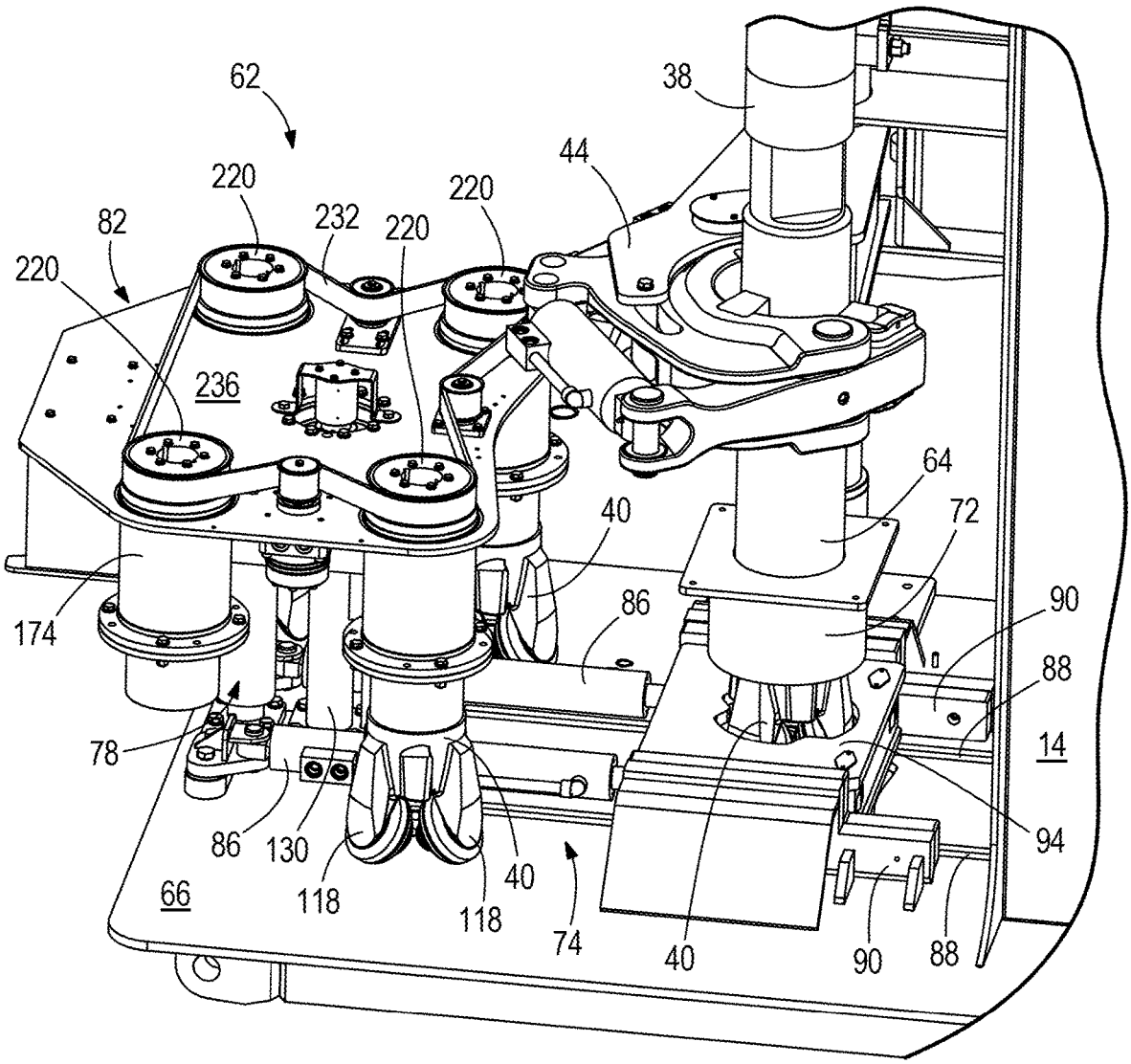
FIG. 2 is a perspective view of a portion of the drill rig, illustrating the bit changer assembly, the bit changer assembly including a bit basket actuator assembly and a drill bit carousel.

With reference to FIGS. 1 and 2, a blasthole drill 10 includes a drill tower 14, a base 18 (e.g., a machinery house) beneath the drill tower 14 that supports the drill tower 14, an operator cab 22 coupled to the base 18, and crawlers 26 driven by a crawler drive 30 that drives the blasthole drill 10 along a ground surface 34. The blasthole drill 10 also includes a drill pipe 38 (e.g., with a drill bit 40, FIG. 2), which is configured to extend downward (e.g., vertically) through the ground surface 34 and into a borehole. In some constructions, multiple drill pipes 38 are connected together to form an elongated drill string that extends into the borehole. As illustrated in FIG. 2, a breakout wrench 44 is moveably coupled to the drill tower 14 adjacent the drill pipe 38 for engaging and ultimately applying a torque to the drill pipe 38 to break the threaded joint between the drill pipe 38 and the drill bit 40.

With continued reference to FIG. 1, the blasthole drill 10 also includes leveling jacks 42 coupled to the base 18 that support the blasthole drill 10 on the ground surface 34, and a brace 46 coupled to both the base 18 and the drill tower 14 that supports the drill tower 14 on the base 18. The drill tower 14 includes a drill head motor 50 coupled to the drill tower 14 that drives a drill head 54 and a coupling 58 that couples together the drill head 54 with an upper end 60 of the drill pipe 38. Other constructions of the blasthole drill 10 do not include, for example, the operator cab 22, the brace 46, or one or more other components as described above.

With reference to FIGS. 1 and 2, the blasthole drill 10 further includes a bit changer assembly 62 that manually or autonomously exchanges the drill bit 40 on a lower end 64 of the drill pipe 38. The bit changer assembly 62 also stores inactive drill bits 40 during operation of the blasthole drill 10. The bit changer assembly 62 is mounted to a drill deck 66. In the illustrated construction, the drill deck 66 is part of the drill tower 14. In some constructions, the drill deck 66 is part of the base 18. The bit changer assembly 62 is mounted adjacent an opening 70 (FIG. 3) of the drill deck 66, of which the drill pipe 38 (and drill bit 40) pass through when drilling a hole in the ground surface 34. A deck bushing 72 is normally disposed within the opening 70 during drilling operations to provide a bearing surface for the drill pipe 38. In the illustrated construction, the bit changer assembly 62 includes a bit basket actuator assembly 74, a mounting assembly 78 coupled to the drill deck 66, and a drill bit carousel 82 rotatably coupled to the mounting assembly 78.

Figure 3:
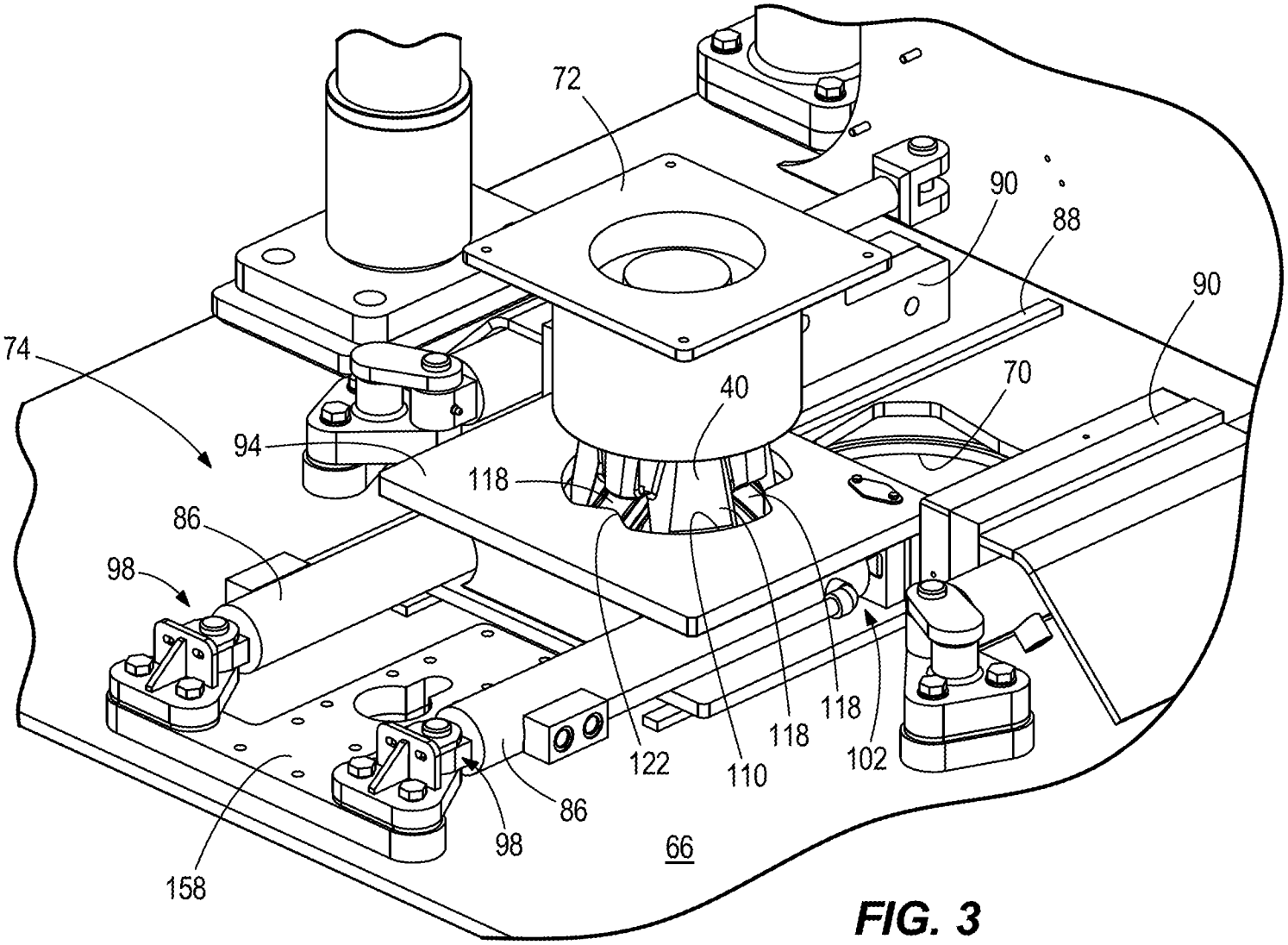
FIG. 3 is a perspective view of the bit basket actuator assembly, illustrating actuators, a drill bit, a deck bushing, and a bit basket supporting the drill bit and the deck bushing.
Figure 4:
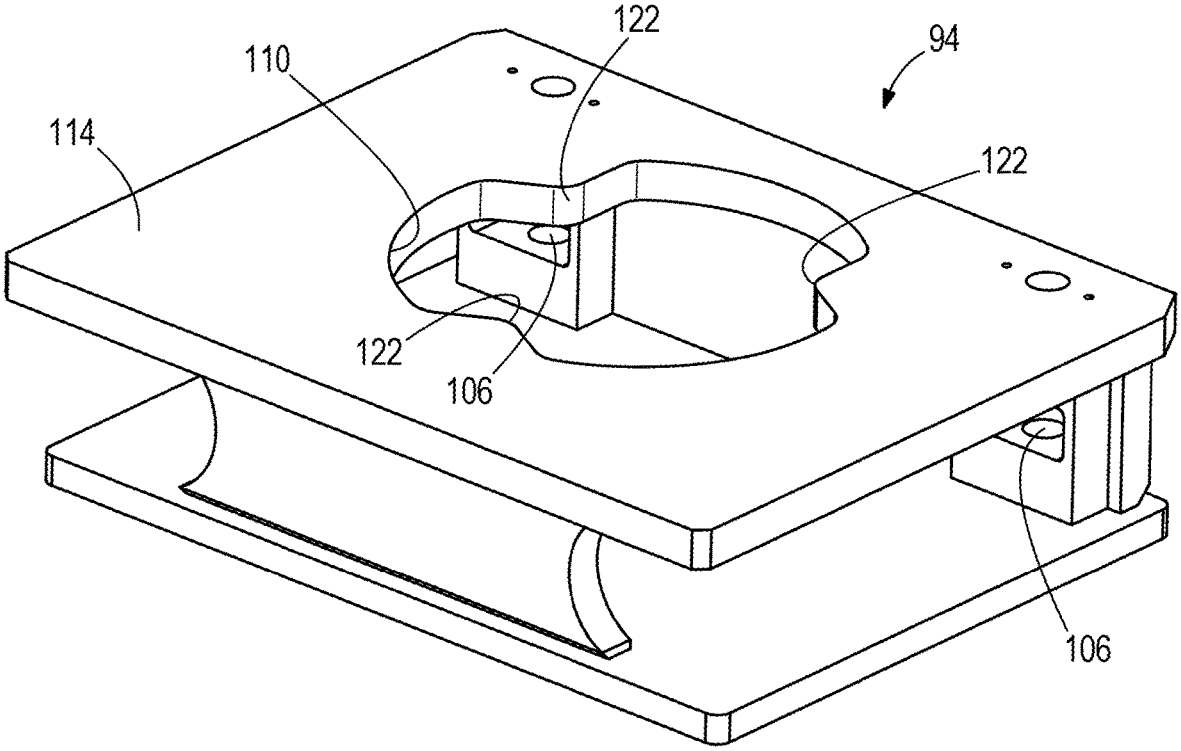
FIG. 4 is a perspective view of the bit basket in FIG. 3.

With reference to FIGS. 2-4, the bit basket actuator assembly 74 assists in unthreading the drill bit 40 from the drill pipe 38 and transports the drill bit 40 and the deck bushing 72 between the drill bit carousel 82 and the opening 70. The bit basket actuator assembly 74 is coupled to the drill deck 66 and interposed between the drill bit carousel 82 and the opening 70 of the drill deck 66. The bit basket actuator assembly 74 includes a pair of actuators 86 (e.g., hydraulic actuators, electric or pneumatic actuators, rack and pinion, etc.), two guiderails 88, two frame guides 90, and a bit basket 94 moveably coupled relative to the guiderails 88 via actuation of the actuators 86. The bit basket 94 rests on and moves along the guiderails 88. The two frame guides 90, which in the illustrated construction are fixed to the drill deck 66, act to guide the bit basket 94 during movement of the bit basket 94. The two frame guides 90 also hold the bit basket 94 in place and resist torque that is applied to the drill bit 40 when the drill bit 40 is being unthreaded from the drill pipe 38. Although there are two illustrated actuators 86 of the bit basket actuator assembly 74, in other constructions, there are fewer or more than two actuators 86.

Referring to FIGS. 3 and 4, in the illustrated construction, the actuators 86 are secured at first ends 98 to the drill deck 66 (or to a plate mounted thereto, such as plate 158 illustrated in FIG. 3). A second end 102 of each actuator 86 is pinned to the bit basket 94 at respective pin joints 106 (FIG. 4), which accommodate slight rotation of the bit basket 94 relative to the actuators 86. As shown in FIGS. 3 and 4, the pin joints 106 are spaced wide enough apart to ensure the actuators 86 will not interfere with any drill bit 40 disposed within the bit basket 94. The pin joints 106 are disposed on the interior of the bit basket 94 such that at least a portion of the actuators 86 extend through the interior of the bit basket 94 when coupled to the bit basket 94. The bit basket 94 further includes an aperture 110 disposed in a top plate 114 of the bit basket 94. The aperture 110 is sized and geometrically configured to allow lobes 118 of the drill bit 40 (e.g., a tricone bit) to pass through the top plate 114 and situate the drill bit 40 in a predetermined orientation. The aperture 110 includes three protrusions 122 that project inwardly to further secure the drill bit 40 within the bit basket 94. For example, when the drill bit 40 is placed in the bit basket 94, the protrusions 122 engage and resist the torque on the lobes 118 of the drill bit 40 while the breakout wrench 44 rotates the drill pipe 38 to unthread the drill bit 40 from the drill pipe 38. Furthermore, the frame guides 90 resist torque imparted on the bit basket 94 (through the protrusions 122) while the drill bit 40 is being unthreaded by the breakout wrench 44.

Figure 5:
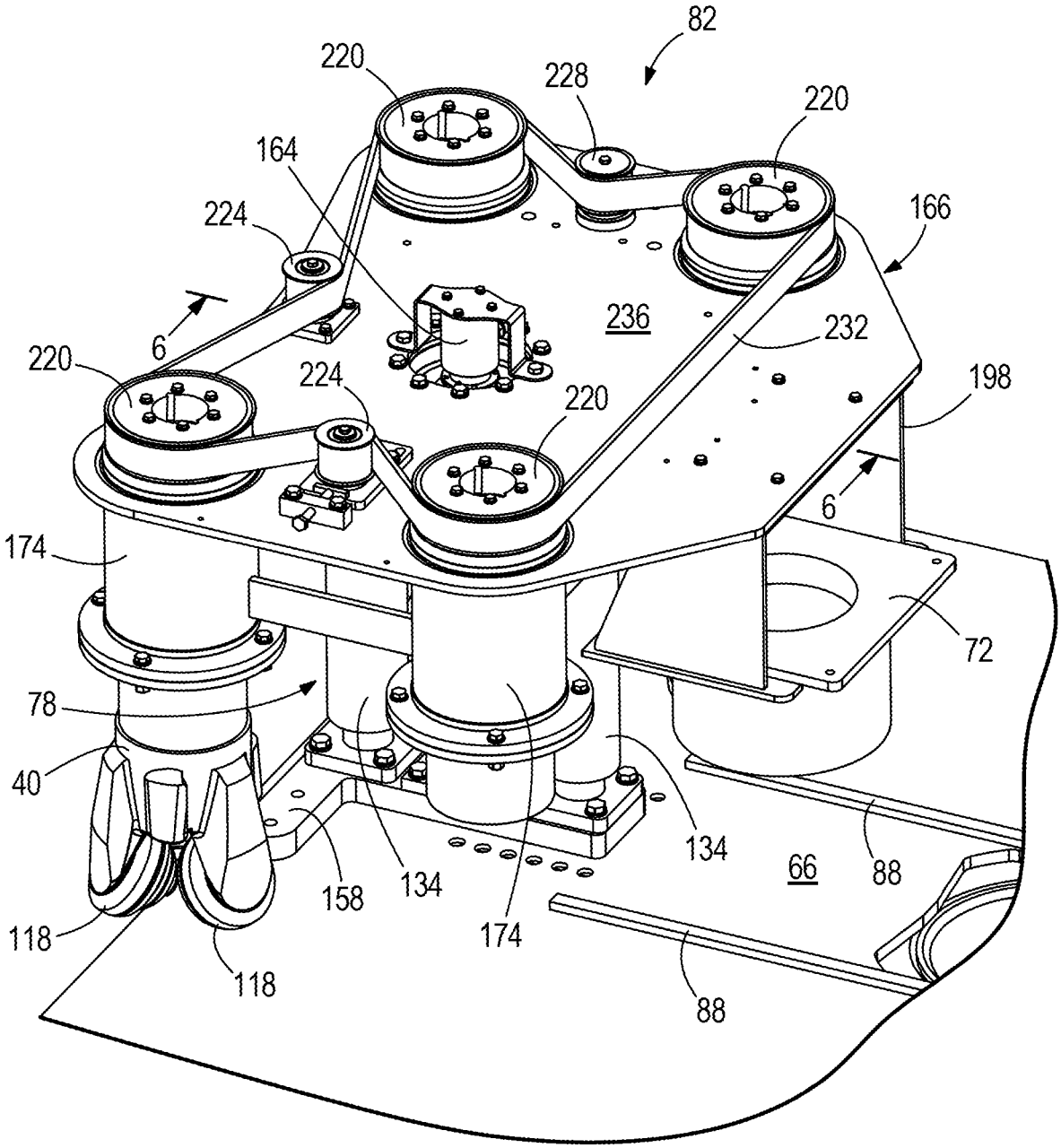
FIG. 5 is a perspective view of the drill bit carousel in FIG. 2.
Figure 6:
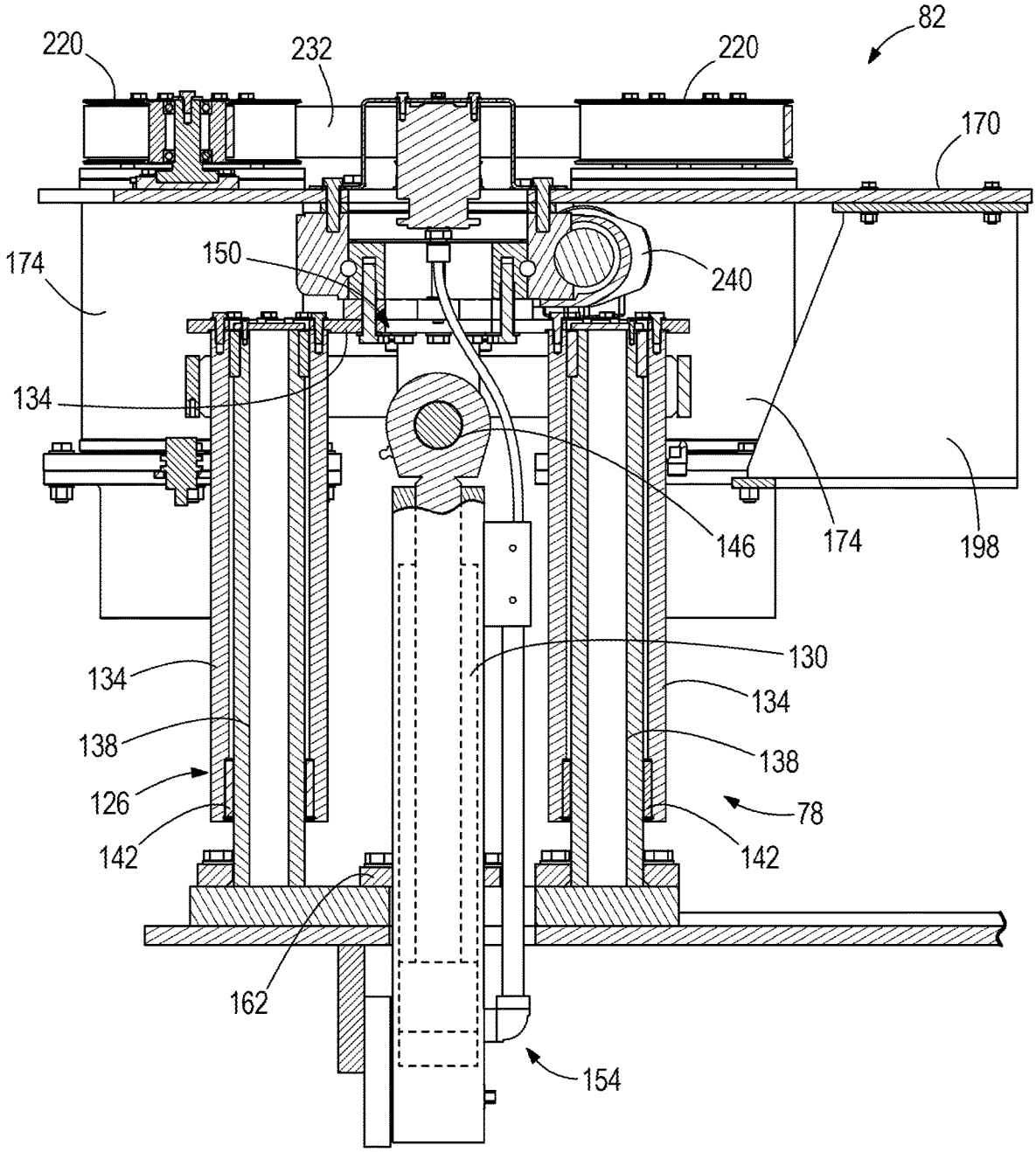
FIG. 6 is a cross sectional view of the drill bit carousel, taken along line 6-6 in FIG. 5.
Figure 9:
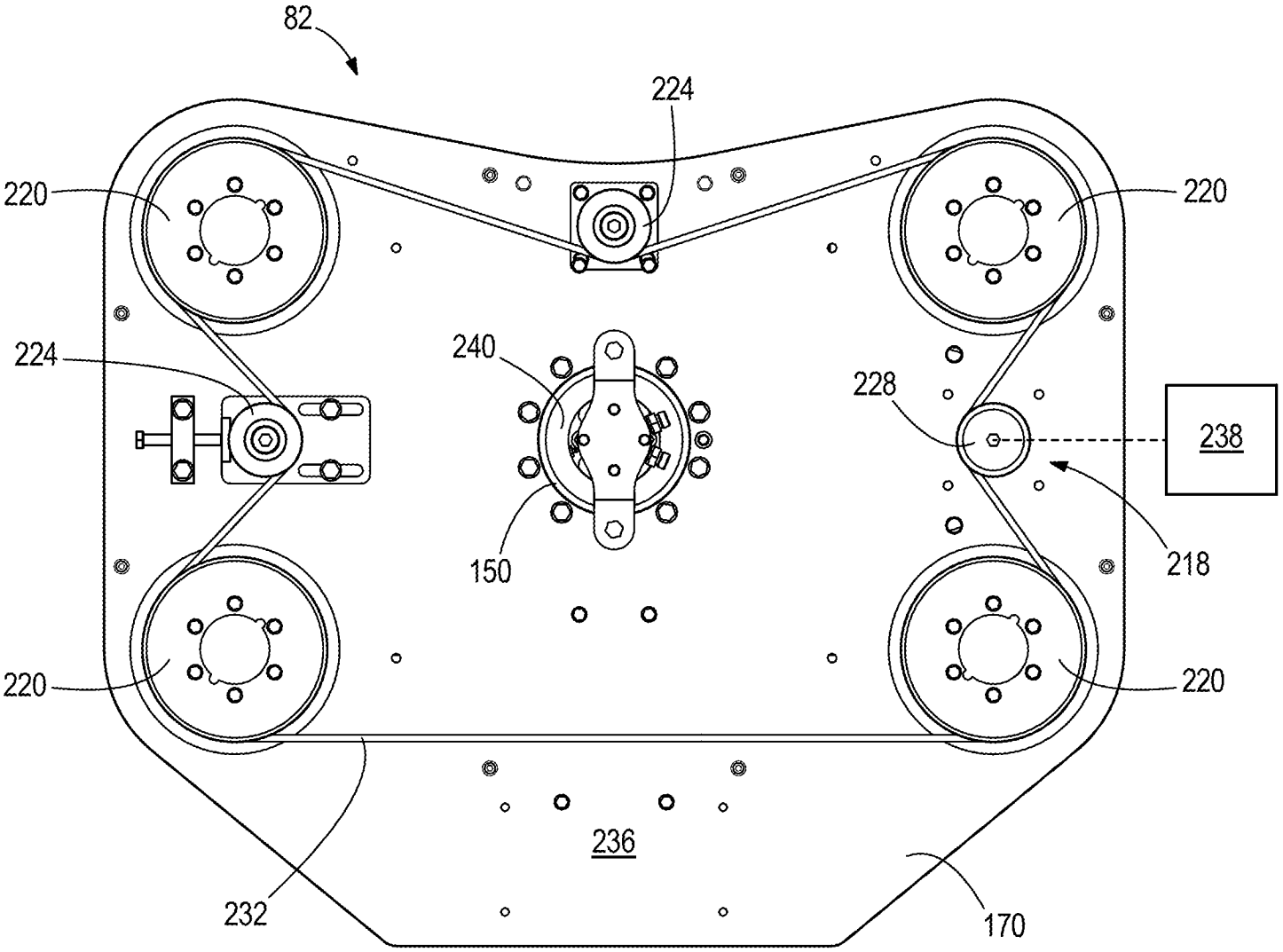
FIG. 9 is a top plan view of the drill bit carousel, illustrating a bit threading drivetrain.

With reference to FIGS. 5 and 6, the drill bit carousel 82 is used for threadably securing the drill bits 40 that are inactive. The drill bit carousel 82 is rotatably and vertically moveable relative to the drill deck 66 via the mounting assembly 78. The mounting assembly 78 is interposed between the drill deck 66 and the carousel 82, and includes a stabilizing unit 126 and an actuator 130. The stabilizing unit 126 facilitates guiding the drill bit carousel 82 through vertical displacement, resisting torque generated from rotating the drill bit carousel 82 (or threading the drill bits 40), and at least partially supporting the weight of the drill bit carousel 82. The stabilizing unit 126 includes a carrier 134 and a set of guides 138 slidably disposed within the carrier 134. A bushing 142 (e.g., linear bearing) is concentrically disposed around each guide 138 to provide a bearing surface between the carrier 134 and the guide 138. The actuator 130 (e.g., a hydraulic cylinder, electric or pneumatic actuator, etc.) of the mounting assembly 78 raises and lowers the carrier 134 (and, in turn, the drill bit carousel 82) along the guides 138. A first end 146 of the actuator 130 is coupled to a mounting area 150 of the carrier 134, whereas a second end 154 of the actuator 130 is secured between the plate 158 (FIG. 3) and the drill deck 66 via a flange 162. The actuator 130 includes a positional feedback indicator (not shown) to allow vertical displacement of the carrier 134 to be sensed and thereby automated. With continued reference to FIG. 5, in the illustrated construction, the drill bit carousel 82 also includes a rotary union 164 that directs hydraulic fluid (or other fluid or material) to a motor 238 (FIG. 9). In other constructions, the rotary union 164 directs hydraulic fluid (or other material) to additional or alternative actuators. In some constructions, the rotary union 164 provides a route for electricity and signals for positional feedback.

Figure 7:
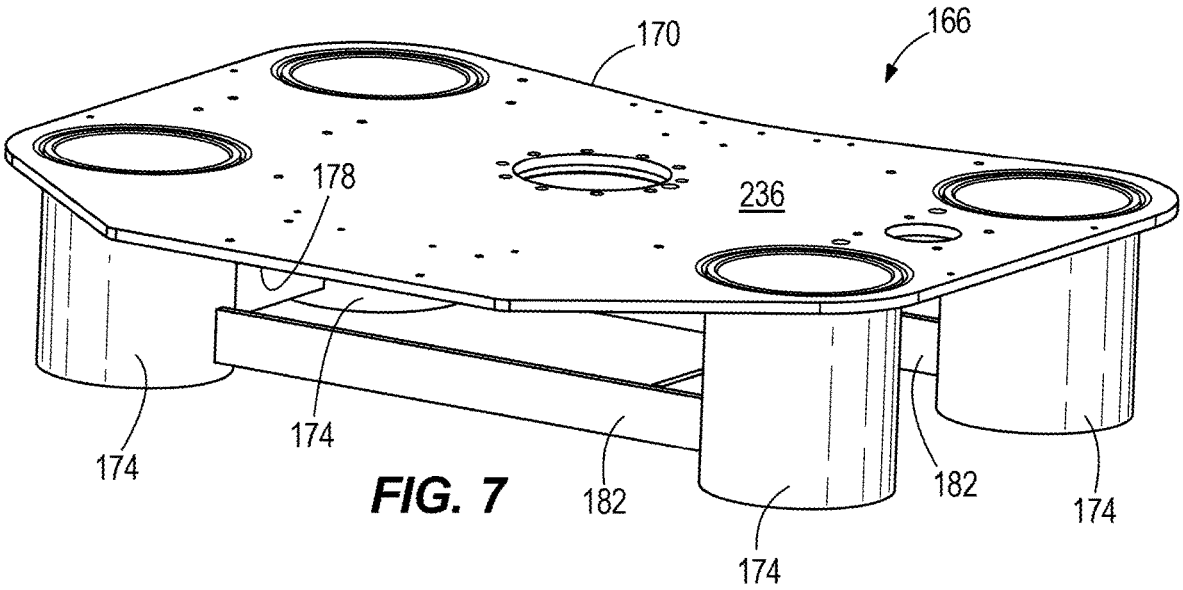
FIG. 7 is a perspective view of a frame of the drill bit carousel, illustrating a plurality of tubes extending from the frame.
Figure 8:
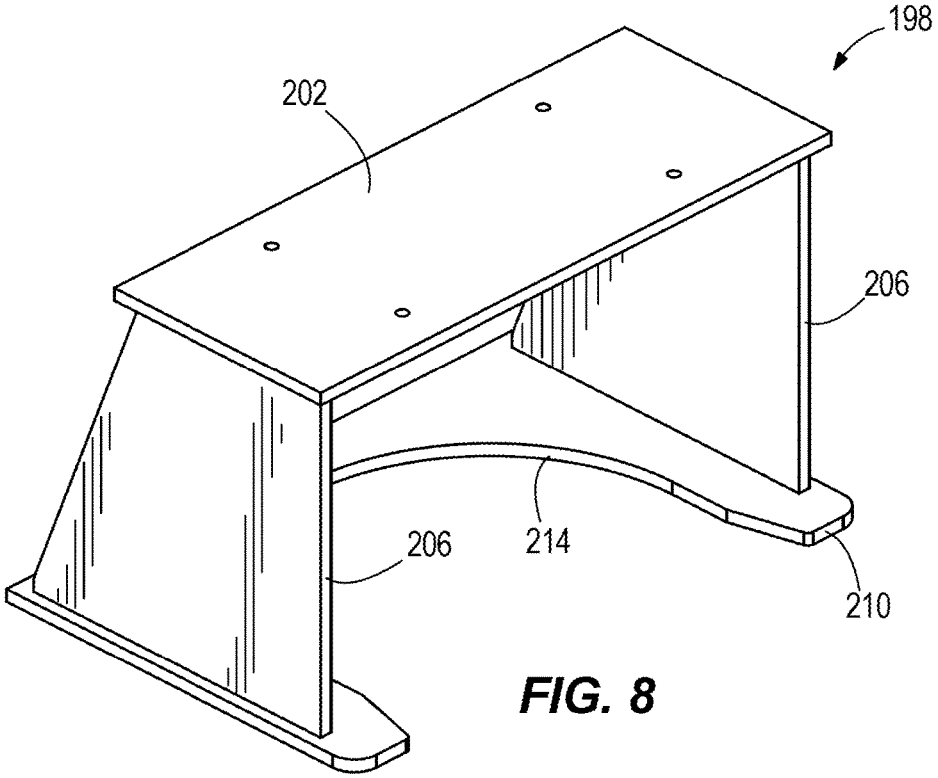
FIG. 8 is a perspective view of a deck bushing holder of the drill bit carousel.
Figure 10:
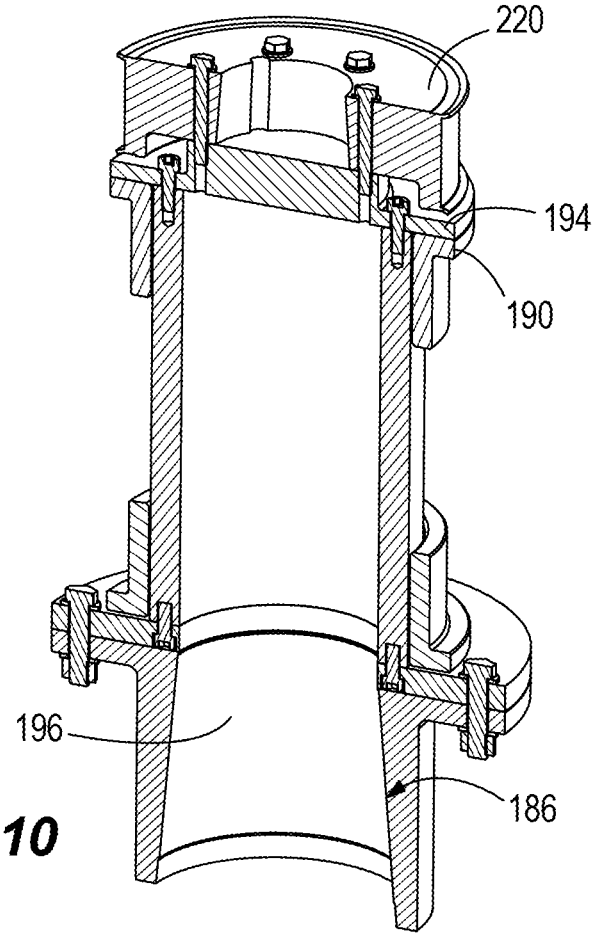
FIG. 10 is a perspective cross sectional view of a threaded insert for use in one of the plurality of tubes.

With reference to FIGS. 7 and 8, the drill bit carousel 82 further includes a frame 166 having a main plate 170, tubes 174 extending from and secured (e.g., welded) to a bottom side 178 of the main plate 170, and stiffening bars 182 interposed between the tubes 174 to reduce deflection of the frame 166 caused by vibration during operation of the blasthole drill 10. With reference to FIG. 10, each tube 174 includes a threaded insert 186 rotatably secured within the tube 174 via a bushing 190 and a washer 194. The threaded insert 186 defines a thread region 196 having a similar thread pattern to a thread region 197 (FIG. 14) of each drill bit 40, thereby allowing each drill bit 40 to be threaded within a corresponding tube 174 and stored on the drill bit carousel 82. As a result, the thread region 197 of each drill bit 40 is protected from damage while in an inactive position. As shown in FIG. 8, the frame 166 further includes a deck bushing holder 198 for selectively holding the deck bushing 72. The deck bushing holder 198 includes a top plate 202, two side plates 206, and a bottom plate 210 having an elongated slot 214 (e.g., arcuate slot) that accommodates the deck bushing 72. As illustrated in FIGS. 5 and 6, the deck bushing holder 198 is coupled to the bottom side 178 of the main plate 170.

With reference to FIGS. 9 and 10, the drill bit carousel 82 further includes a bit threading drivetrain 218 for threading each drill bit 40 within corresponding tubes 174 and unthreading each drill bit 40 in order to place the drill bit 40 in the bit basket 94. The bit threading drivetrain 218 includes tube sprockets 220, idler sprockets 224, a drive sprocket 228, and a drive member 232 (e.g., belt, chain, etc.) for rotationally driving each sprocket. Each tube sprocket 220 is coupled to a corresponding threaded insert 186 (FIG. 10) adjacent a top side 236 of the main plate 170. The threaded inserts 186 sit within and are rotated within the tubes 174. As illustrated in FIGS. 9 and 10, the idler sprockets 224 are positioned on the top side 236 of the main plate 170 between adjacent tube sprockets 220. The idler sprockets 224 guide the drive member 232 along the contours of the main plate 170, shorten unsupported distances of the drive member 232, and increase wrap or "contact" of the drive member 232 for each tube sprocket 220 and drive sprocket 228. At least one of the idler sprockets 224 is permitted to be adjusted to increase or decrease tension in the drive member 232. The drive sprocket 228, driven by the motor 238 (illustrated schematically), is mounted to the bottom side 178 of the main plate 170. The drive member 232 is engaged with each sprocket (i.e., the tube sprockets 220, the idler sprockets 224, and the drive sprocket 228) such that the drive sprocket 228, which is driven by the motor 238, rotates each tube sprocket 220, and therefore each threaded insert 186 simultaneously and in the same direction. Other constructions include different numbers and arrangement of sprockets. In some constructions, a guard (not shown) is coupled to the top side 236 of the main plate 170 to guard the moving drive member 232 and each sprocket 220, 224, 228. Although the bit threading drivetrain 218 of the illustrated construction includes a drive member 232 in the form of a belt, in other constructions, the bit threading drivetrain 218 includes a chain, gears, and/or direct drives/motors (e.g., four direct drive motors) coupled to each tube sprocket 220. In some constructions, clutches are used to engage and disengage each tube sprocket 220.

Figure 11:
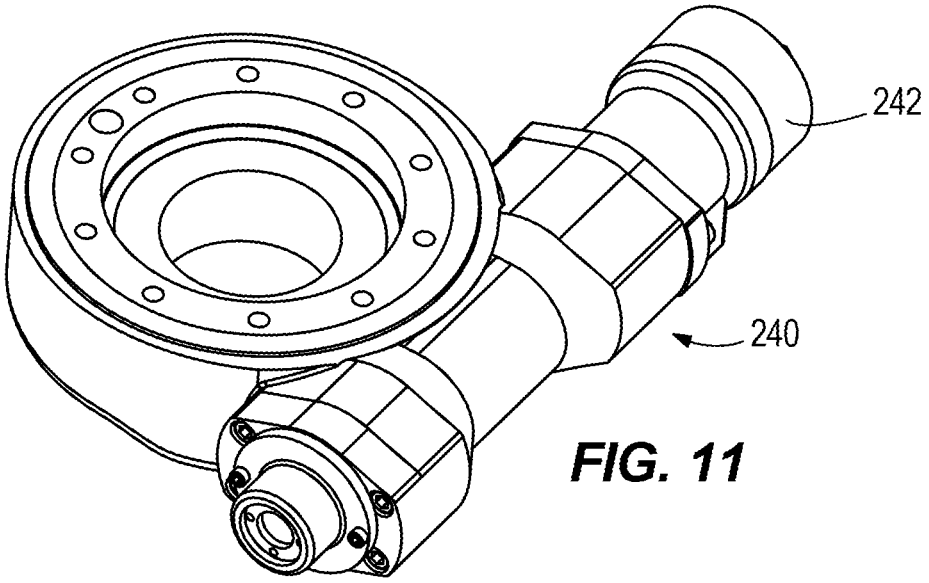
FIG. 11 is a perspective view of a slew drive for the drill bit carousel.

With reference to FIGS. 6 and 11, in the illustrated construction, a slew drive 240 is mounted on the carrier 134, and is coupled to an underside of the main plate 170, such that the slew drive 240 moves with the carrier 134 and rotates the main plate 170. The slew drive 240 includes a motor 242 (FIG. 11). In response to activation of the slew drive 240, the main plate 170 of the drill bit carousel 82, and the frame 166 overall, rotate relative to the carrier 134 of the stabilizing unit 126. In some constructions, the slew drive 240 has a positional feedback indicator (not shown) to provide angular displacement information of the frame 166 relative to the carrier 134. In some constructions, the slew drive 240 also, or alternatively, has a self-locking feature (not shown), eliminating the need for a brake between the frame 166 and the carrier 134. In some constructions, the frame 166 rotates relative to the carrier 134 through a different type (or number) of motor and gear assembly.

In some constructions, the process of exchanging and storing the drill bits 40 of the blasthole drill 10 is entirely automated, whereas in other constructions, a substantial portion or portions of the process are automated. In the illustrated construction, up to four drill bits 40 can be stored on the drill bit carousel 82 at a time by threading the drill bits 40 into the threaded insert 186, as discussed in further detail below. However, there are three drill bits 40 stored on the drill bit carousel 82 during a drill operation, with at least one of the threaded inserts 186 remaining empty for the drill bit 40 that is on the drill pipe 38, as shown in FIG. 2. In other constructions, the drill bit carousel 82 stores fewer or greater than four drill bits 40 (e.g., has fewer or greater than four tubes 174).

Figure 12:
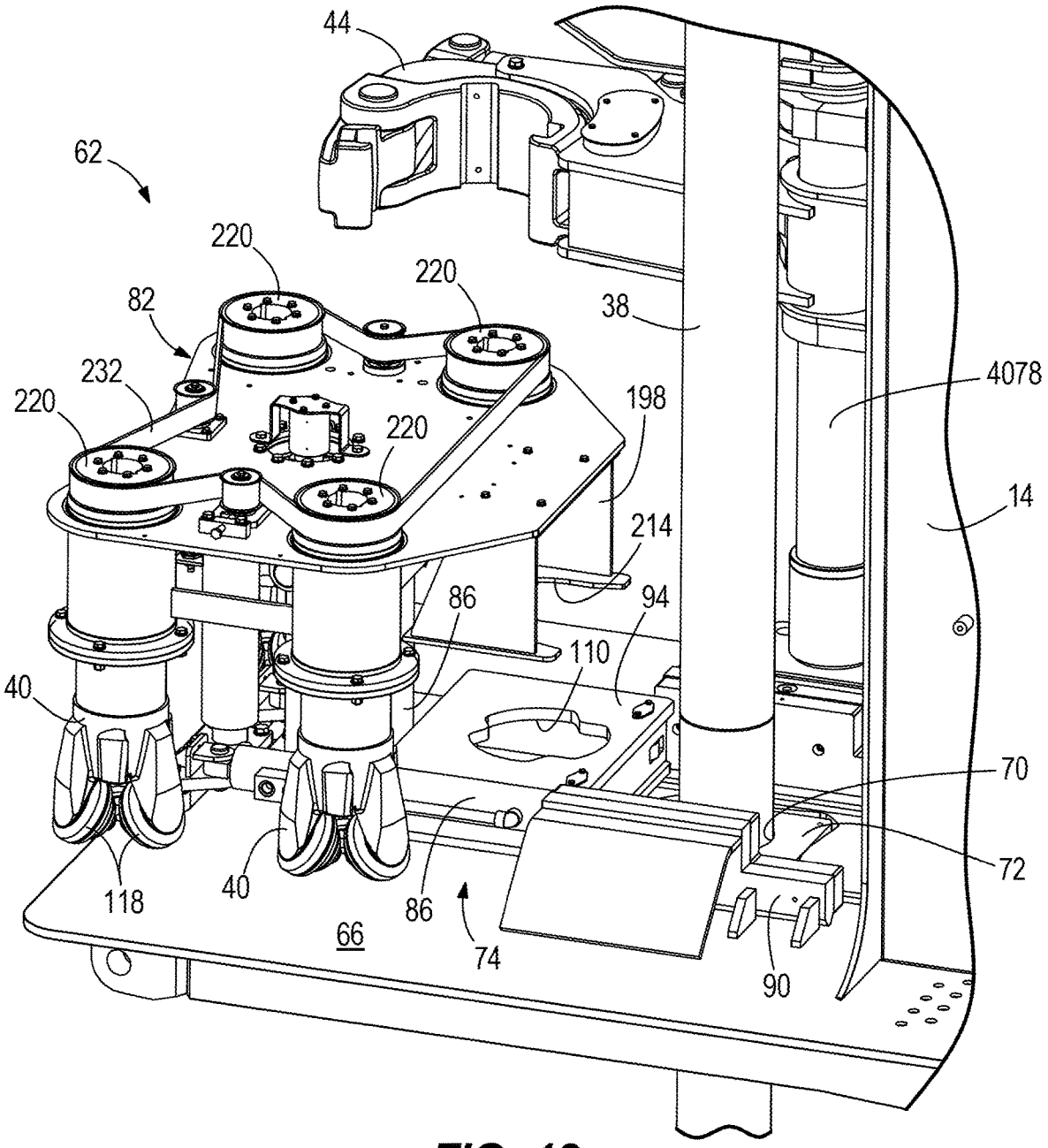
FIG. 12 is a perspective view of the bit changer assembly when the drill rig is performing a drill operation.

With reference to FIGS. 2 and 12-16, in order to replace a drill bit 40 that is coupled to the drill pipe 38, the drill bit 40 must first be raised above the drill deck 66. In doing so, the deck bushing 72 that is normally disposed within the opening 70 and around the drill pipe 38 (a corner of the deck bushing 72 is shown in FIG. 12) engages the drill bit 40 such that the deck bushing 72 is raised out of the opening 70 and above the drill deck 66 along with the drill bit 40 (FIG. 2). Although the deck bushing 72 engages the drill bit 40 when the drill bit 40 is raised out of the opening 70, the deck bushing 72 is merely resting on top of the drill bit such that a non-rigid connection forms between the deck bushing 72 and the drill bit 40. Once the drill bit 40 is raised to a desired height, the bit basket 94 is actuated via the actuators 86 from a first, or "stored position", in which the bit basket 94 is spaced away from the opening 70 (FIG. 12), to a second, or "extended position", in which the aperture 110 of the bit basket 94 is substantially concentric with the opening 70 and the drill bit 40 (FIG. 2). The drill bit 40 is then lowered into the bit basket 94 (FIG. 2). As the drill bit 40 is lowered the drill bit 40 is oriented within the bit basket 94 by each protrusion 122 adjacent the aperture 110, the protrusions 122 fitting between adjacent lobes 118 of the drill bit 40. With continued reference to FIG. 2, the breakout wrench 44 is then pivoted towards and engages the drill pipe 38 to unthread the drill bit 40 from the drill pipe 38. Once the drill pipe 38 and the drill bit 40 are uncoupled, the drill pipe 38 is actuated vertically to provide clearance between the drill pipe 38 and the deck bushing 72.

Figure 13:
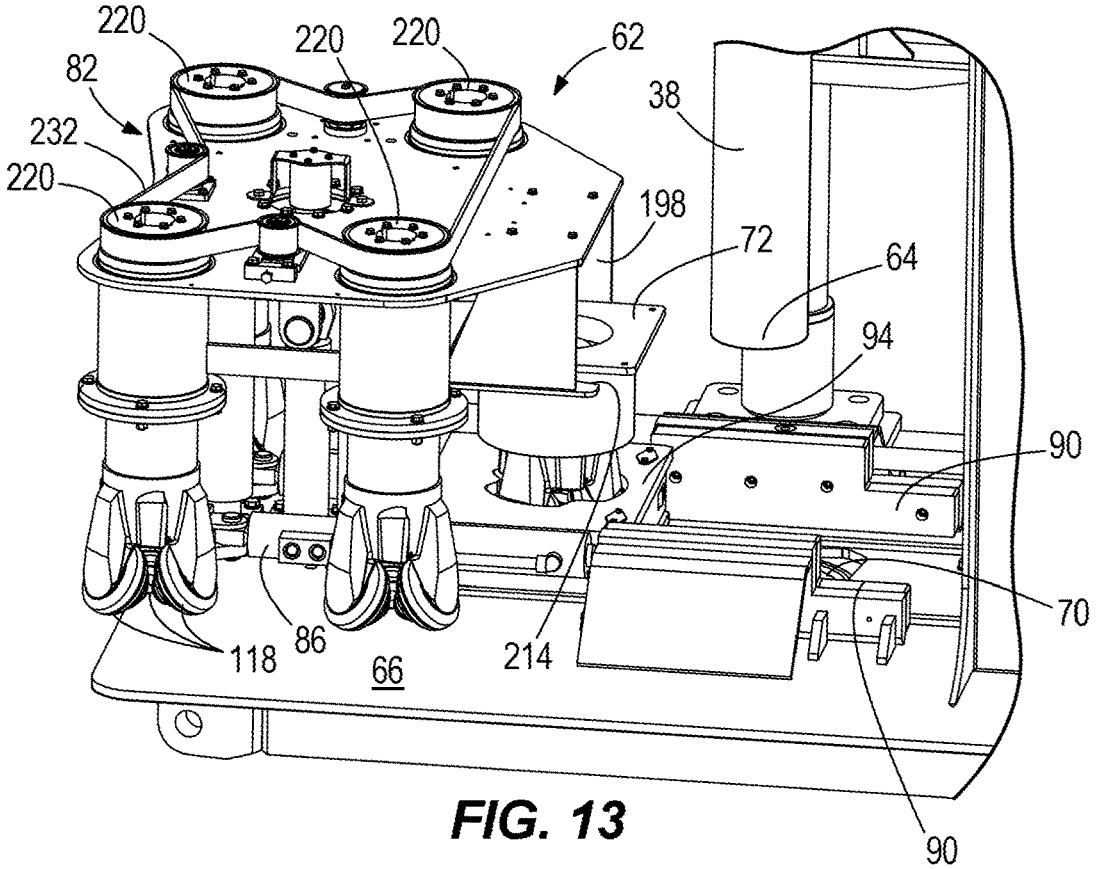
FIG. 13 is a perspective view of the bit changer assembly during a bit changing operation.

With reference to FIG. 13, with the deck bushing holder 198 oriented toward the drill pipe 38, the bit basket 94 is actuated toward the stored position, moving the drill bit 40 and the deck bushing 72 along with the bit basket 94 toward the deck bushing holder 198. The deck bushing 72 slides into the elongated slot 214 of the deck bushing holder 198 when the bit basket 94 is in the stored position.

Figure 14:
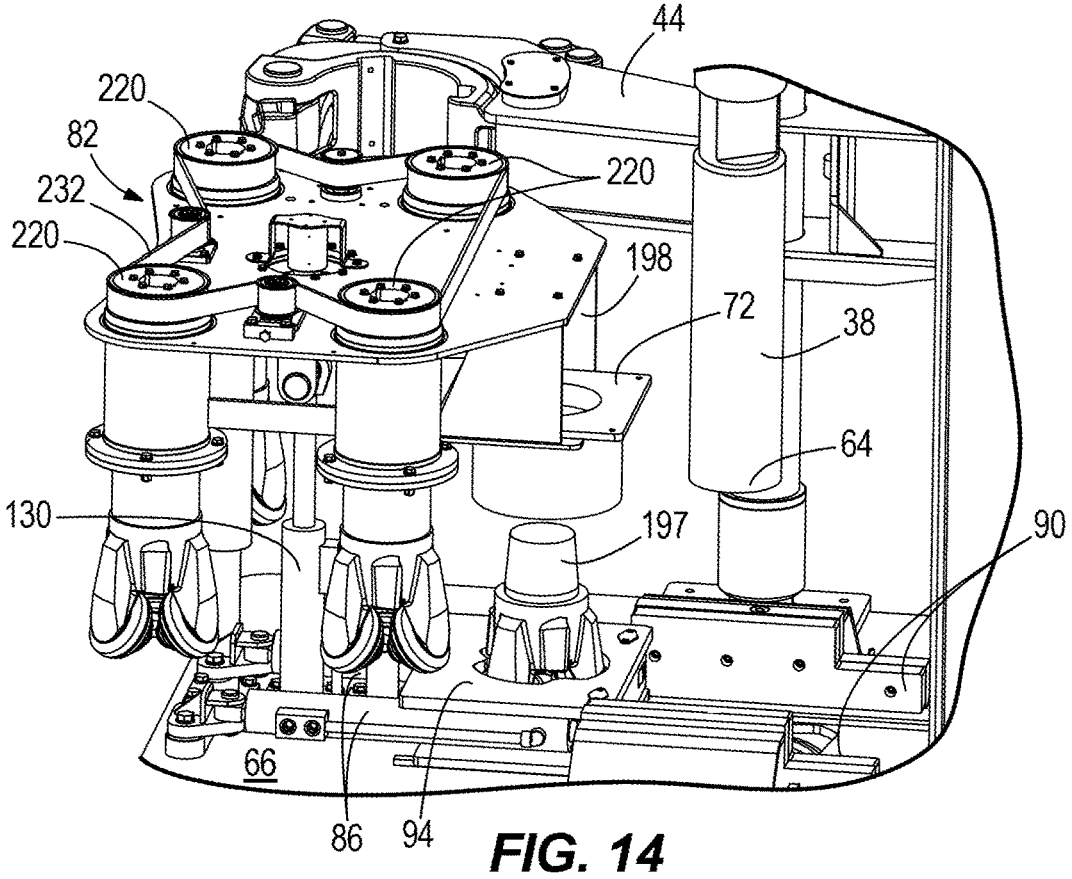
FIG. 14 is another perspective view of the bit changer assembly during a bit changing operation.

In the illustrated construction, the process of interchanging the drill bits 40 occurs once the deck bushing 72 is retained in the deck bushing holder 198 and lifted above the drill bit 40. For example, and as illustrated in FIG. 14, the drill bit carousel 82 is raised by actuating the actuator 130 of the mounting assembly 78. The slew drive 240 is subsequently activated to rotate the frame 166 of the drill bit carousel 82 until an empty tube 174 of the frame 166 is concentric with the drill bit 40 disposed within the bit basket 94.

Figure 15:
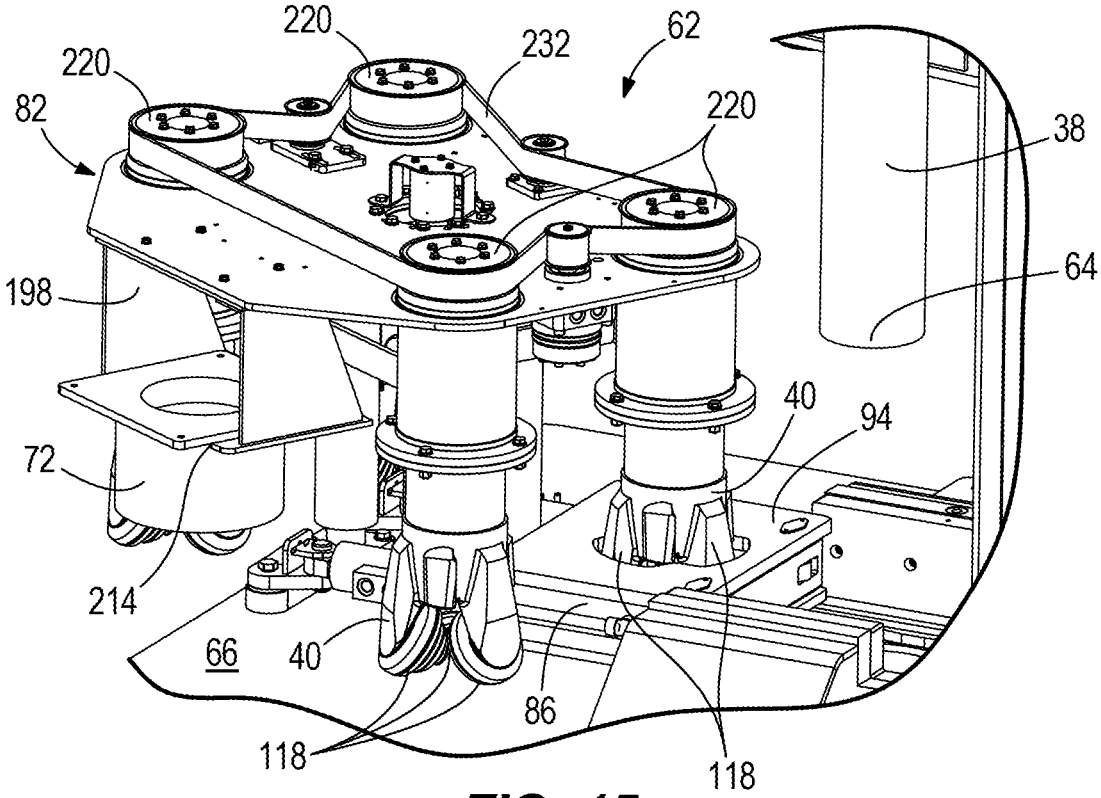
FIG. 15 is yet another perspective view of the bit changer assembly during a bit changing operation.

With reference to FIG. 15, the drill bit carousel 82 is then lowered (through actuation of the actuator 130) in tandem with activation of the motor 238 of the bit threading drivetrain 218. As such, each tube sprocket 220 and threaded insert 186 rotate in unison. The drill bit 40 disposed within the bit basket 94 threads into the empty threaded insert 186 once the respective threaded regions engage each other. However, the remaining drill bits 40 coupled to the drill bit carousel 82 merely co-rotate with their threaded insert 186 as there is no component (e.g., the bit basket 94) interacting with the drill bit 40 to impart a torque on the lobes 118 of the drill bits 40. Once the drill bit 40 is threaded onto the drill bit carousel 82, the drill bit carousel 82 is raised again, rotated until a new drill bit 40 is concentric with the bit basket 94, and is then lowered until the new drill bit 40 is received within the bit basket 94. At this point, the motor 238 of the bit threading drivetrain 218 is activated in a reverse direction in order to unthread the new drill bit 40 from its threaded insert 186.

Figure 16:
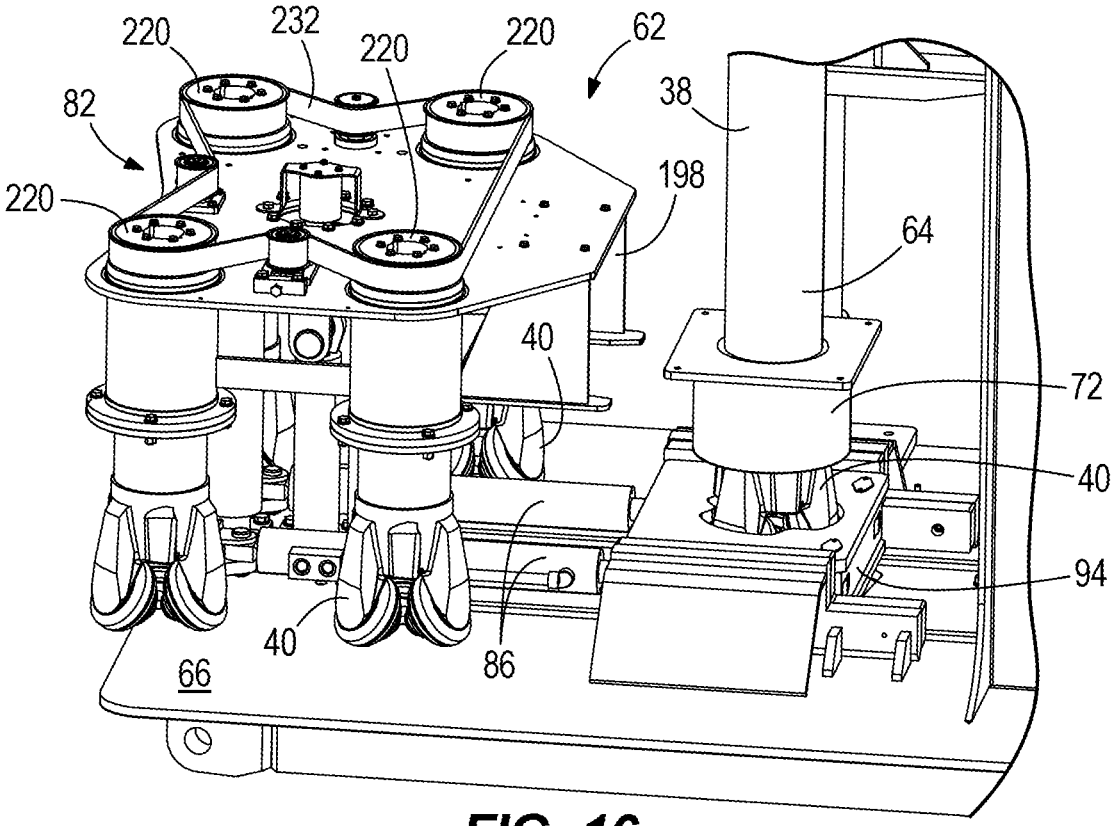
FIG. 16 is yet another perspective view of the bit changer assembly during a bit changing operation.

With reference to FIG. 16, after a new drill bit 40 is unthreaded from the bit carousel 82, the drill bit carousel 82 is rotated so the deck bushing 72 is properly disposed above the a top of the new drill bit 40. The drill bit carousel 82 is then lowered, so that the deck bushing 72 is placed over the top of the new drill bit 40. The bit basket 94 (with the deck bushing 72 and new drill bit 40 contained therein) is then actuated toward the extended position to situate the new drill bit 40 and the deck bushing 72 concentric, or substantially concentric, with the opening 70 of the drill deck 66. The drill pipe 38 is then coupled to the drill bit 40 via the drill head motor 50, and the drill pipe 38 can be momentarily raised to provide clearance for the bit basket 94 to actuate back to the stored position. Drilling then commences with the new drill bit 40.

In some constructions, the bit carousel 82 is positioned close enough to the drill pipe(s) 38 that the actuators 86, frame guides 90, and bit basket 94 are removed entirely from the bit changer assembly 62. In these constructions, the bit carousel 82 may rotate until the deck bushing holder 198 (or other suitable structure either on the bit carousel 82 or exterior of the bit carousel 82) engages the deck bushing 72 and lifts the deck bushing 72 off of the drill bit 40. The bit carousel 82 may then be rotated until an empty tube 174 is positioned over the drill bit 40, and the drill bit 40, which may include exterior threads, may then be threaded into the empty tube 174. When not in use, the drill bit carousel 82 may be rotated such that it is not interfering with the drill pipe(s) 38 and operation of the blasthole drill 10.

Figure 17:
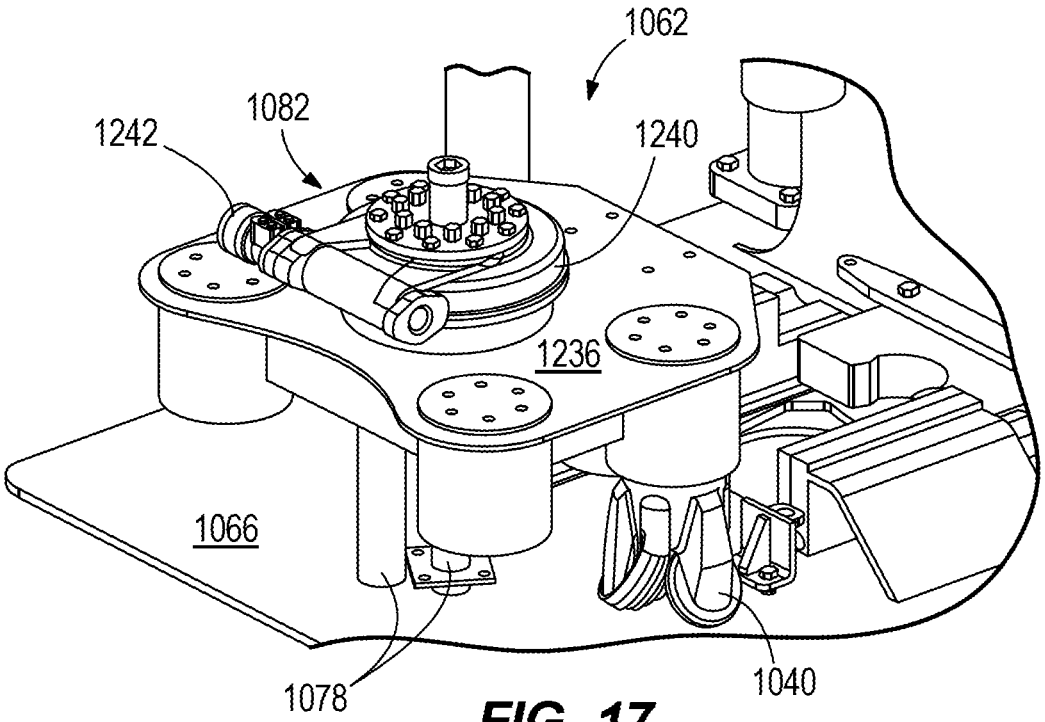
FIG. 17 is a perspective view of a bit changer assembly according to another construction.

FIG. 17 illustrates a bit changer 1062 including a drill bit carousel 1082 according to another construction. The drill bit carousel 1082 is similar to the drill bit carousel 82 described above with reference to FIGS. 1-16, and similar parts have been given the same reference number plus 1000. Only differences between the constructions are described.

As illustrated in FIG. 17, the drill bit carousel 1082 includes the slew drive 1240 mounted thereto for rotating the drill bit carousel 1082 relative to the drill deck 1066. In this particular configuration of the drill bit carousel 1082, the slew drive 1240 is suspended such that the slew drive 1240 is mounted adjacent the top side 1236 of the drill bit carousel 1082. This configuration enables the drill bit carousel 1082 to be smaller in circumference as the drill bits 1040 can be positioned in closer proximity with respect to each other because the drill bits 1040 are no longer capable of interfering with the large swept area of the slew drive 1240.

Figure 18:
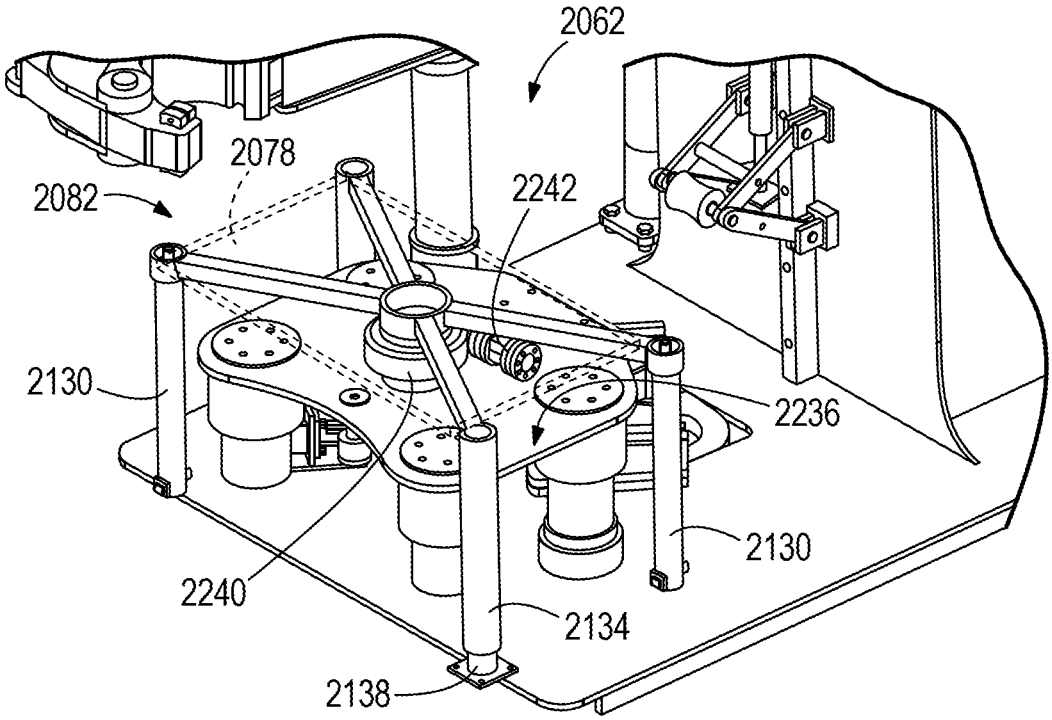
FIG. 18 is a perspective view of a bit changer assembly according to another construction.

FIG. 18 illustrates a bit changer 2062 including a drill bit carousel 2082 according to another construction. The drill bit carousel 2082 is similar to the drill bit carousel 82 described above with reference to FIGS. 1-16, and similar parts have been given the same reference number plus 2000. Only differences between the constructions are described.

As illustrated in FIG. 18, the drill bit carousel 2082 includes the slew drive 2240 mounted thereto for rotating the drill bit carousel 2082 relative to the drill deck 2066. Similar to the construction of FIG. 17, the slew drive 2240 is suspended such that the slew drive 2240 is mounted adjacent the top side 2236 of the drill bit carousel 2082. However, rather than supporting the drill bit carousel 2082 from below, the drill bit carousel 2082 is supported from above via the mounting assembly 2078. Specifically, the suspended slew drive 2240 is mounted to a larger structure with the carrier 2134, the guides 2138, and the actuator 2130 located outside a swing radius of the drill bit carousel 2082.

Figure 19:
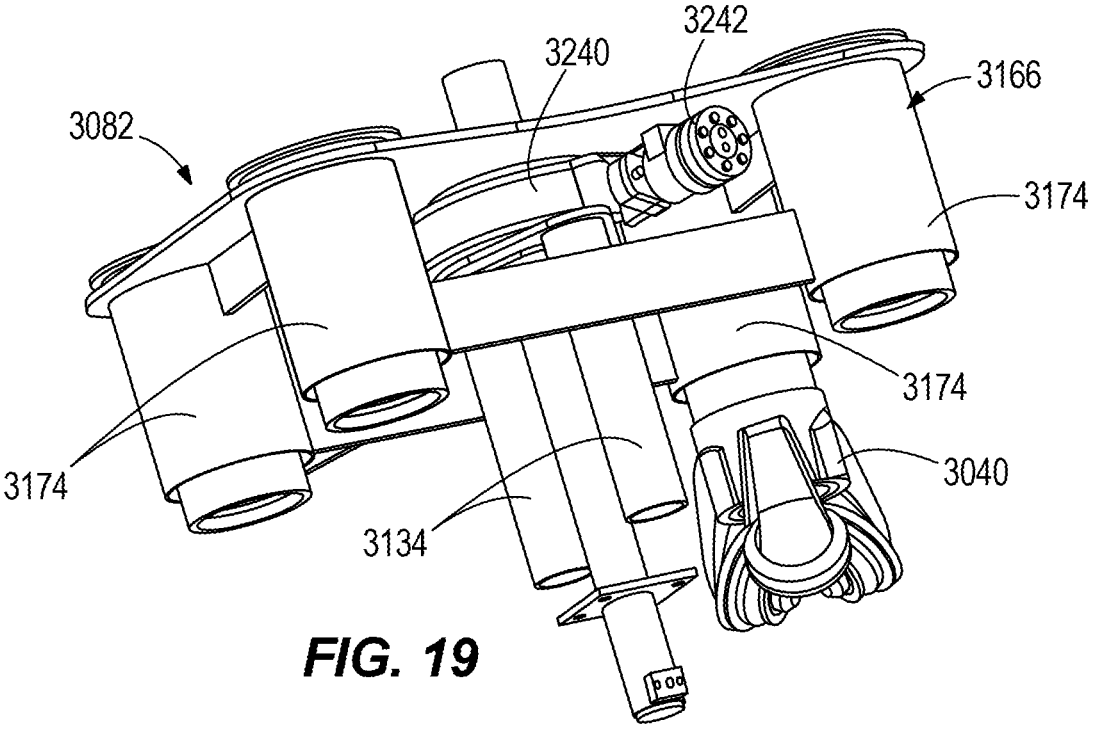
FIG. 19 is a perspective view of a bit changer assembly according to another construction.

FIG. 19 illustrates a drill bit carousel 3082 according to another construction. The drill bit carousel 3082 is similar to the drill bit carousel 82 described above with reference to FIGS. 1-16, and similar parts have been given the same reference number plus 3000. Only differences between the constructions are described.

As illustrated in FIG. 19, a swept area of the slew drive 3240 is primarily a result of a motor 3242 that extends from the body of the slew drive 3240 rotating relative to the frame 3166 of the drill bit carousel 3082. Therefore, in order to minimize the swept area of the slew drive 3240 relative to the frame 3166 of the drill bit carousel 3082 (and therefore the plurality of tubes 3174), the motor 3242 of the slew drive 3240 is rigidly mounted to the frame 3166. Accordingly, the rotating portion of the slew drive 3240 is mounted to the carrier 3134 so the motor 3242 of the slew drive 3240 co-rotates with the frame 3166. Although not shown, a larger rotary union, additional plumbing, and a slip ring may also be provided for this configuration.

Figure 20:
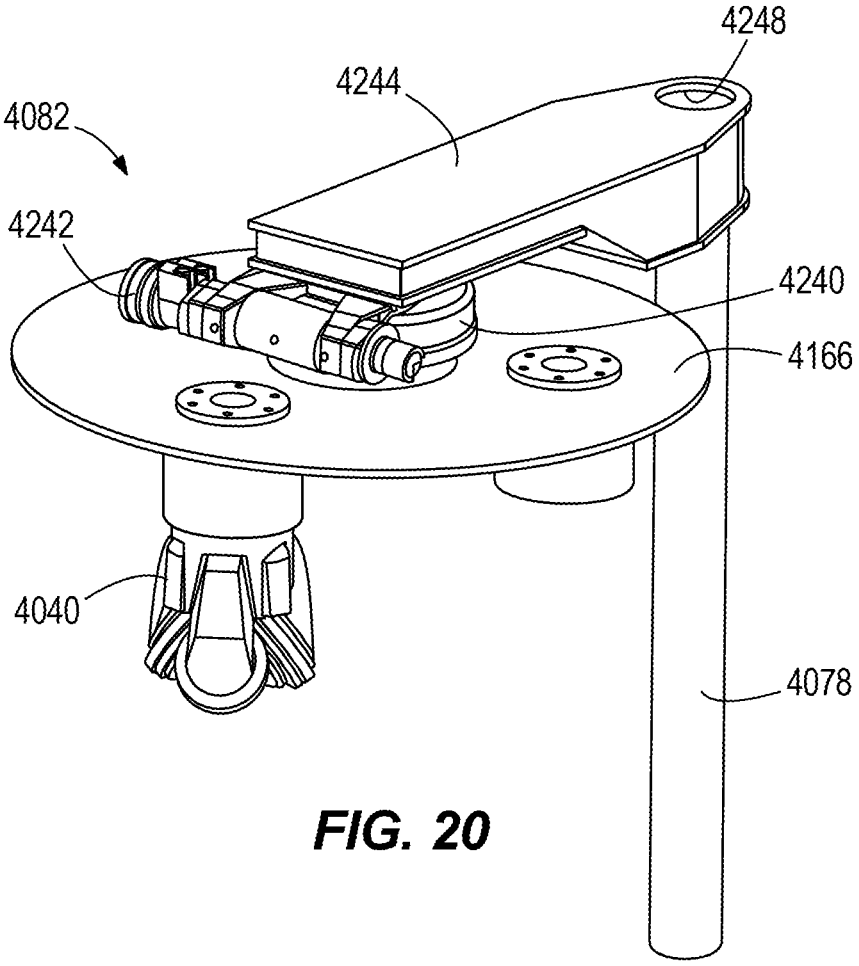
FIG. 20 is a perspective view of a bit changer assembly according to another construction.

FIG. 20 illustrates a drill bit carousel 4082 according to another construction. The drill bit carousel 4082 is similar to the drill bit carousel 82 described above with reference to FIGS. 1-16, and similar parts have been given the same reference number plus 4000. Only differences between the constructions are described.

As illustrated in FIG. 20, the drill bit carousel 4082 is suspended and supported by a swing arm 4244, which in turn is supported by the mounting member 4078 at joint 4248, rather than being supported from below the drill bit carousel 4082. The swing arm 4244 swings the drill bit carousel 4082 over a bit basket for exchanging the drill bits 4040. In the illustrated construction, the frame 4166 of the drill bit carousel 4082 is suspended from the slew drive 4240. In some constructions, the swing arm 4244 is coupled to the same mounting structure that supports the breakout wrench 4044 (see, e.g., FIG. 12 illustrating the mounting member 4078 and breakout wrench 4044).

As an option for maintenance of the drill bit carousel 82, 1082, 2082, 3082, 4082, a platform (not shown) is mounted to the top of the drill bit carousel 82, 1082, 2082, 3082, 4082 (or the guard could be modified to be a platform) for an operator to stand on. This may be as simple as a reinforced guard with anti-slip tape or as complex as additional structure to mount deck grating on.

Additionally, because the drill bits 40 are suspended in the drill bit carousels 82, 1082, 2082, 3082, 4082, rather than set into a pot, protection is provided to the threads of the drill bits 40 while the drill bits 40 are stored. In some constructions, rather than threading the drill bits 40 into the drill bit carousels 82, 1082, 2082, 3082, 4082, other means of retention may be used to keep the drill bits 40 mounted to the drill bit carousels 82, 1082, 2082, 3082, 4082. For instance, in some constructions, a permanent magnet or an electromagnet may apply a magnetic force on the top of the drill bit 40 to hold the drill bit 40 in the drill bit carousels 82, 1082, 2082, 3082, 4082. Alternatively, in other constructions, an expanding mandrel or mandrels, for example ones similar to those used in paper processing, are lowered into an annular opening used for air flow in the drill bit 40 and expanded to lift the drill bit 40. In some constructions, expanding chucks or mandrels expand radially outwardly against an interior surface of the drill bit 40 to hold the drill bit 40 in place within the tube 174.

As noted above, changing out drill bits of a blasthole drill is one of the most dangerous operations during the use of the blasthole drill, primarily because of the weight of the moving components during the changing process. For example, in some constructions, the drill bits 40 weigh approximately 70 kg each (for a B1 class machine), the deck bushing 72 weighs approximately 81 kg, and the bit basket 94 weighs approximately 37 kg. Other constructions include different values and ranges of values. Providing an autonomous solution to exchange the drill bits 40, such as that described above, provides a safer environment on-board the blasthole drill 10 by limiting operator interaction with the moving components. In some constructions, for example, the drill bit changer assembly 62 reduces the time required to change the drill bits 40 from 60 minutes to 10 minutes. Furthermore, the drill bits 40, which are typically stored loosely on the drill deck 66, are stored effectively on the drill bit carousel 82. Storing the drill bits 40 in a threaded joint protects the threaded regions of the drill bits 40 and increases longevity of the drill bits 40, thus ensuring a consistent, repeatable connections of the drill bits 40 to the drill pipe 38.

Although the invention has been described in detail with reference to certain preferred constructions, variations and modifications exist within the scope and spirit of one or more independent aspects of the invention as described.

What is claimed is:

1. A bit changer assembly comprising:

a bit basket configured to be coupled to a drill rig, wherein the bit basket is sized and shaped to receive a drill bit for the drill rig, and is configured to resist torque applied to a drill pipe by a breakout wrench of the drill rig; and a bit holding device configured to be coupled to the drill rig, wherein the bit holding device is configured to move the drill bit directly to the bit basket when the bit basket is aligned with a drill pipe of the drill rig;

wherein the bit holding device includes a main body, and openings defined by the main body to receive the drill bit and other drill bits.

2. The bit changer assembly of claim 1, wherein the bit holding device is a rotatable bit carousel.

3. The bit changer assembly of claim 2, wherein the bit carousel includes a deck bushing holder configured to engage a deck bushing of the drill rig.

4. The bit changer assembly of claim 1, wherein the bit holding device includes a tube configured to hold the drill bit, wherein the tube defines one of the openings.

5. The bit changer assembly of claim 4, wherein the tube includes interior threads.

6. The bit changer assembly of claim 4, wherein the bit holding device includes a threading drivetrain to thread the drill bit within the tube.

7. The bit changer assembly of claim 1, wherein the bit basket includes a top plate and an aperture disposed in the top plate, wherein the aperture is sized and shaped for lobes of the drill bit to pass through the top plate and for the drill bit to be positioned in a predetermined orientation in the bit basket.

8. The bit changer assembly of claim 1, wherein the bit holding device is movable vertically along an axis that is configured to be parallel to an axis of the drill pipe.

9. The bit changer assembly of claim 1, further comprising a mounting assembly configured to be mounted to the drill rig, wherein the bit holding device is rotatably coupled to the mounting assembly, wherein the mounting assembly includes a stabilizing unit and an actuator, wherein the actuator is configured to displace the bit holding device vertically, and wherein the stabilizing unit is configured to guide the bit holding device through vertical displacement.

10. The bit changer assembly of claim 1, wherein the bit holding device includes a rotary union.

11. A mining machine comprising:

a drill rig having a base, a drill tower extending from the base, a drill pipe coupled to and extending from the drill tower, and a breakout wrench; and the bit changer assembly of claim 1 coupled to the drill rig.

12. The mining machine of claim 11, wherein the breakout wrench is configured to apply the torque to the drill pipe to unthread the drill bit from the drill pipe, and wherein the bit basket of the bit changer assembly is configured to resist the torque.

13. The mining machine of claim 11, wherein the bit holding device of the bit changer assembly is a rotatable carousel.

14. The mining machine of claim 11, wherein the drill pipe defines a drill pipe axis, and wherein the bit holding device of the bit changer assembly is movable vertically along an axis that is parallel to the drill pipe axis.

15. The mining machine of claim 11, further comprising a mounting assembly mounted to the drill rig, wherein the bit holding device of the bit changer assembly is rotatably coupled to the mounting assembly, wherein the mounting assembly includes a stabilizing unit and an actuator, wherein the actuator is configured to displace the bit holding device vertically, and wherein the stabilizing unit is configured to guide the bit holding device through vertical displacement.

16. The mining machine of claim 11, wherein the bit holding device of the bit changer assembly includes a rotary union to direct one of hydraulic fluid or electricity.

17. The mining machine of claim 11, wherein the drill rig includes a deck bushing, and wherein the bit holding device of the bit changer assembly includes a deck bushing holder configured to engage the deck bushing of the drill rig and to lift the deck bushing.

18. The mining machine of claim 11, wherein the drill pipe defines a drill pipe axis, and wherein the bit basket of the bit changer assembly is movable along a region of the drill rig both toward and away from the drill pipe axis.

19. The mining machine of claim 18, wherein the bit basket is movable linearly along the region of the drill rig.

20. A bit changer assembly comprising:

a bit basket configured to be coupled to a drill rig, wherein the bit basket is sized and shaped to receive a drill bit for the drill rig, and is configured to resist torque applied to a drill pipe by a breakout wrench of the drill rig; and a bit holding device configured to be coupled to the drill rig, wherein the bit holding device is configured to move the drill bit directly to the bit basket when the bit basket is aligned with a drill pipe of the drill rig;

wherein the bit holding device is a rotatable bit carousel.

21. A bit changer assembly comprising:

a first bit holding device configured to be coupled to a drill rig, wherein the first bit holding device includes a main body and openings defined by the main body to receive a plurality of drill bits; and a second bit holding device having a top plate, and an aperture along the top plate, wherein the first bit holding device is configured transfer one of the drill bits to the second bit holding device such that the drill bit is disposed within the aperture, wherein the second bit holding device is sized and shaped such that the second bit holding device is configured to resist torque that is applied to a drill pipe of the drill rig when the drill bit is disposed within the aperture.

22. The bit changer assembly of claim 21, wherein the first bit holding device is configured to move the drill bit so that the drill bit is directly aligned with the drill pipe of the drill rig.

23. The bit changer assembly of claim 21, wherein the first bit holding device further includes a deck bushing holder sized and shaped to engage a deck bushing on the drill rig, wherein the deck bushing holder is configured to lift the deck bushing.

24. The bit changer assembly of claim 23, wherein the deck bushing holder includes a top plate, two side plates, and a bottom plate having an elongated slot configured to accommodate the deck bushing.

25. The bit changer assembly of claim 21, wherein the first bit holding device includes a tube configured to hold the drill bit, and wherein the tube includes interior threads.

26. A mining machine comprising:

a drill rig having a base, a drill tower extending from the base, a drill pipe coupled to and extending from the drill tower, a deck bushing, and a breakout wrench; and the bit changer assembly of claim 21;

wherein the breakout wrench is configured to apply torque to the drill pipe.

* * * * *